US009371217B1

(12) United States Patent
DePumpo

(10) Patent No.: US 9,371,217 B1
(45) Date of Patent: Jun. 21, 2016

(54) LARGE WHEELED, HAND OPERATED FORKLIFT

(71) Applicant: Mark C. DePumpo, Denver, CO (US)

(72) Inventor: Mark C. DePumpo, Denver, CO (US)

( * ) Notice: Subject to any disclaimer, the term of this patent is extended or adjusted under 35 U.S.C. 154(b) by 121 days.

(21) Appl. No.: 13/890,848

(22) Filed: May 9, 2013

(51) Int. Cl.

| | |
|---|---|
| ***B66F 9/06*** | (2006.01) |
| ***B66F 9/20*** | (2006.01) |
| ***B66F 9/075*** | (2006.01) |
| ***B66F 7/06*** | (2006.01) |

(52) U.S. Cl.
CPC . *B66F 9/06* (2013.01); *B66F 7/065* (2013.01); *B66F 9/075* (2013.01); *B66F 9/20* (2013.01)

(58) Field of Classification Search
CPC ..... B66F 7/065; B66F 7/0666; B66F 9/06; B66F 9/075; B66F 9/07545
USPC ..... 187/211, 269
See application file for complete search history.

(56) References Cited

U.S. PATENT DOCUMENTS

| | | | | | |
|---|---|---|---|---|---|
| 29,751 | A * | 8/1860 | Allen | 187/269 | |
| 593,806 | A * | 11/1897 | Keenan | 187/269 | |
| 956,189 | A * | 4/1910 | Schwarz | 187/269 | |
| 1,342,982 | A * | 6/1920 | Boehck | 187/231 | |
| 1,689,259 | A * | 10/1928 | Shepard, Jr. et al. | 187/231 | |
| 1,885,170 | A * | 11/1932 | Anderson | 254/9 R | |
| 2,175,041 | A * | 10/1939 | Thumim | B66C 23/48 | 187/235 |
| 2,483,894 | A * | 10/1949 | Feibel | 187/269 | |
| 2,894,605 | A * | 7/1959 | Leavitt | 187/224 | |
| 3,085,656 | A * | 4/1963 | Hopfeld | 187/231 | |
| 3,186,571 | A * | 6/1965 | Holzhause | 187/225 | |
| 3,385,401 | A * | 5/1968 | Campbell et al. | 187/222 | |
| 3,563,401 | A * | 2/1971 | Gandolfo | B66F 9/07545 | 280/756 |
| 4,365,921 | A * | 12/1982 | Brouwer et al. | 414/347 | |
| 4,655,466 | A * | 4/1987 | Hanaoka | 280/47.371 | |
| D302,894 | S * | 8/1989 | Suzuki | D34/31 | |
| 4,867,277 | A * | 9/1989 | Sloan | 187/243 | |
| 4,941,797 | A * | 7/1990 | Smillie, III | 414/462 | |
| 5,379,855 | A * | 1/1995 | Juang | 187/269 | |
| 5,454,625 | A * | 10/1995 | Christensen et al. | 298/18 | |
| 5,586,620 | A * | 12/1996 | Dammeyer et al. | 187/227 | |
| 5,649,608 | A * | 7/1997 | Sakakibara | 187/231 | |
| 6,343,674 | B1 * | 2/2002 | Sexsmith | B66F 9/22 | 180/19.2 |
| 6,371,449 | B1 * | 4/2002 | Chamberlain | B66F 7/02 | 254/10 C |
| 6,511,080 | B2 * | 1/2003 | Lee | 280/43.12 | |
| 7,093,691 | B1 * | 8/2006 | Vaughan et al. | 187/269 | |
| 8,084,716 | B2 * | 12/2011 | Day | B60L 1/02 | 219/203 |
| 8,418,607 | B2 * | 4/2013 | Kachkovsky | 100/45 | |
| 2006/0086569 | A1 * | 4/2006 | Brown, Sr. | 182/63.1 | |
| 2006/0180401 | A1 * | 8/2006 | Bourgeois | 187/250 | |
| 2010/0277584 | A1 * | 11/2010 | Price | 348/143 | |
| 2011/0206489 | A1 * | 8/2011 | Ford | B66F 9/07513 | 414/639 |

* cited by examiner

*Primary Examiner* — Minh Truong
(74) *Attorney, Agent, or Firm* — Edwin H. Crabtree; Ramon L. Pizarro

(57) ABSTRACT

A hand operated forklift with either a cable winch lift assembly or scissor arm lift assembly for lifting pallets and other heavy items. The forklift includes a mast assembly having a mast frame with winch assembly and winch cable mounted thereon. The mast frame is mounted on top of a mast base frame. The frame includes a pair of large front wheels and a pair of large rear pivot wheels. A handle is attached to the rear of the frame for turning the rear wheels and moving the forklift. A fork assembly is mounted on front of the mast assembly and includes a fork frame and two adjustable, "L" shaped lift forks. The forks are used for engaging and lifting pallets. The fork frame is slidably mounted on the mast frame and connected to a lift assembly. The lift assembly is used for raising and lowering the fork frame and forks on the mast frame.

7 Claims, 9 Drawing Sheets

146

LARGE WHEELED, HAND OPERATED FORKLIFT

BACKGROUND OF THE INVENTION (a) Field of the Invention

This invention relates to a mobile, hand operated, forklift and more particularly, but not by way of limitation, to a large wheeled, lightweight, portable, hand operated forklift with a hand operated or battery powered lift assembly for lifting pallets of product and other heavy items.

(b) Discussion of Prior Art

Heretofore, there have been a large number of different types of expensive gasoline and electric powered, mobile forklifts with operator seat. More recently, smaller, less expense, battery operated forklifts called "lift stackers" have been introduced to the market. Lift stackers include adjustable forks, lift height of 6 to 7 feet and a load capacity in a range of 1000 to 2000 pounds.

The subject forklift is unique in that it is small, lightweight, inexpensive, and hand operated. The forklift is ideal for a small business for periodically loading and unloading heavy items on pallets and the like.

SUMMARY OF THE INVENTION

In view of the foregoing, it is a primary objective of the subject invention to provide an inexpensive, lightweight, hand operated forklift for handling loads up to 2000 pounds. The forklift includes a pair of outrigger arm members with large front wheels that straddle a pair of lift forks for stability and to prevent tipping during the lifting of heavy loads.

Another object is the forklift includes large front and rear wheels for ease in handling, loading and unloading pallets from a delivery truck and other types of vehicles.

Still another object of the forklift is the use of either a hand operated cable lift assembly, a battery operated cable lift assembly or a scissor arm lift assembly for raising and lowering lift forks.

Yet another object of the invention is the forklift is easy to assemble and rugged in construction for lifting items from floor level to heights up to 50 inches and greater.

The subject portable forklift includes a mast assembly having a vertical mast frame with lift assembly mounted thereon. The vertical mast frame is mounted on top of a horizontal mast base frame. The mast base frame includes a pair of large front wheels and a pair of large rear pivot wheels. A handle is attached to the rear of the mast base frame for turning the rear wheels and moving the forklift when loading and unloading various items. A fork assembly is mounted on front of the mast assembly and includes an external vertical fork frame and two outwardly extending, adjustable, "L" shaped lift forks. The lift forks are used for engaging and lifting pallets and other large items. The external vertical fork frame is connected to an internal horizontal crossbar. The crossbar is connected to one end of the lift assembly. The lift assembly is used for raising and lowering the crossbar, the external vertical fork frame and lift forks on the vertical mast frame.

These and other objects of the present invention will become apparent to those familiar with various types of forklifts and forklift frames when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the principles thereof, and in which.

DETAILED DESCRIPTION OF THE PREFERRED EMBODIMENTS

Figure 1:
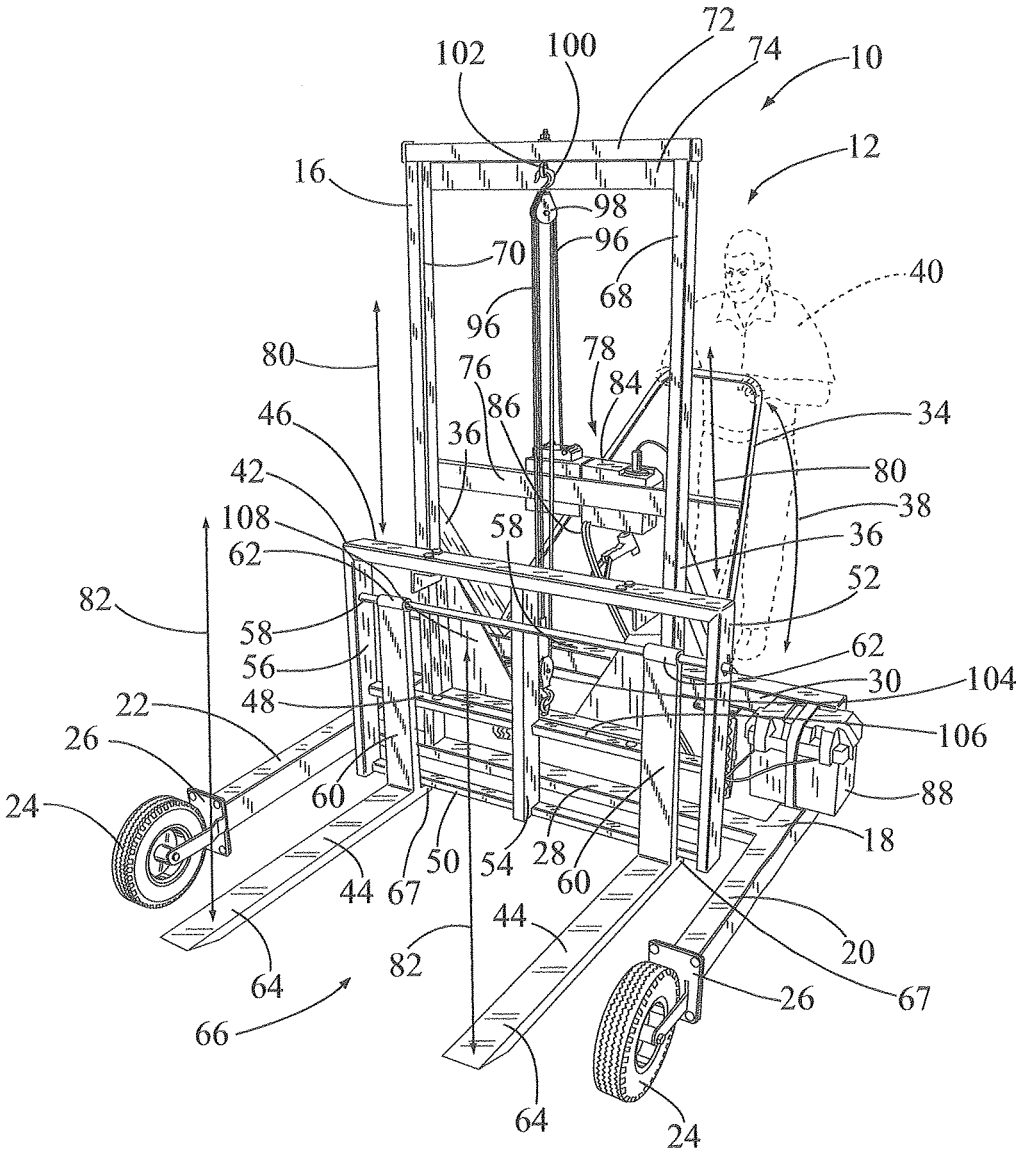
FIG. 1 is a front perspective view of the subject hand operated forklift and illustrating two "L" shaped lift forks mounted on a external vertical fork frame and in a lowered position next to a floor. An operator, illustrated in dashed lines, is shown holding a "U" shaped handle for moving the forklift into position for loading goods on the two forks.

In FIG. 1, a front perspective view of the subject hand operated forklift is shown and having general reference numeral 10. The forklift 10 broadly includes a wheel mounted, mast assembly having a general reference numeral 12 and a fork assembly having a general reference numeral 14.

The mast assembly 12 includes a vertical mast frame 16 mounted on top of a horizontal mast base frame 18. The mast base frame 18 provides overall stability to prevent tipping of the forklift 10 when raising and lowering heavy loads. The base frame 18 includes a first outrigger arm member 20 and a parallel second outrigger arm member 22 with a pair of large front wheels 24 attached to end plates 26 mounted on ends of the arm members 20 and 22. The base frame 18 also includes a lower mast crossbar 28 and an elevated rear wheel crossbar 30. The ends of the crossbars 28 and 30 are attached to rear of the outrigger arm members 20 and 22. A pair of large rear pivot wheels 32 are attached to the rear wheel crossbar 30.

Figure 2:
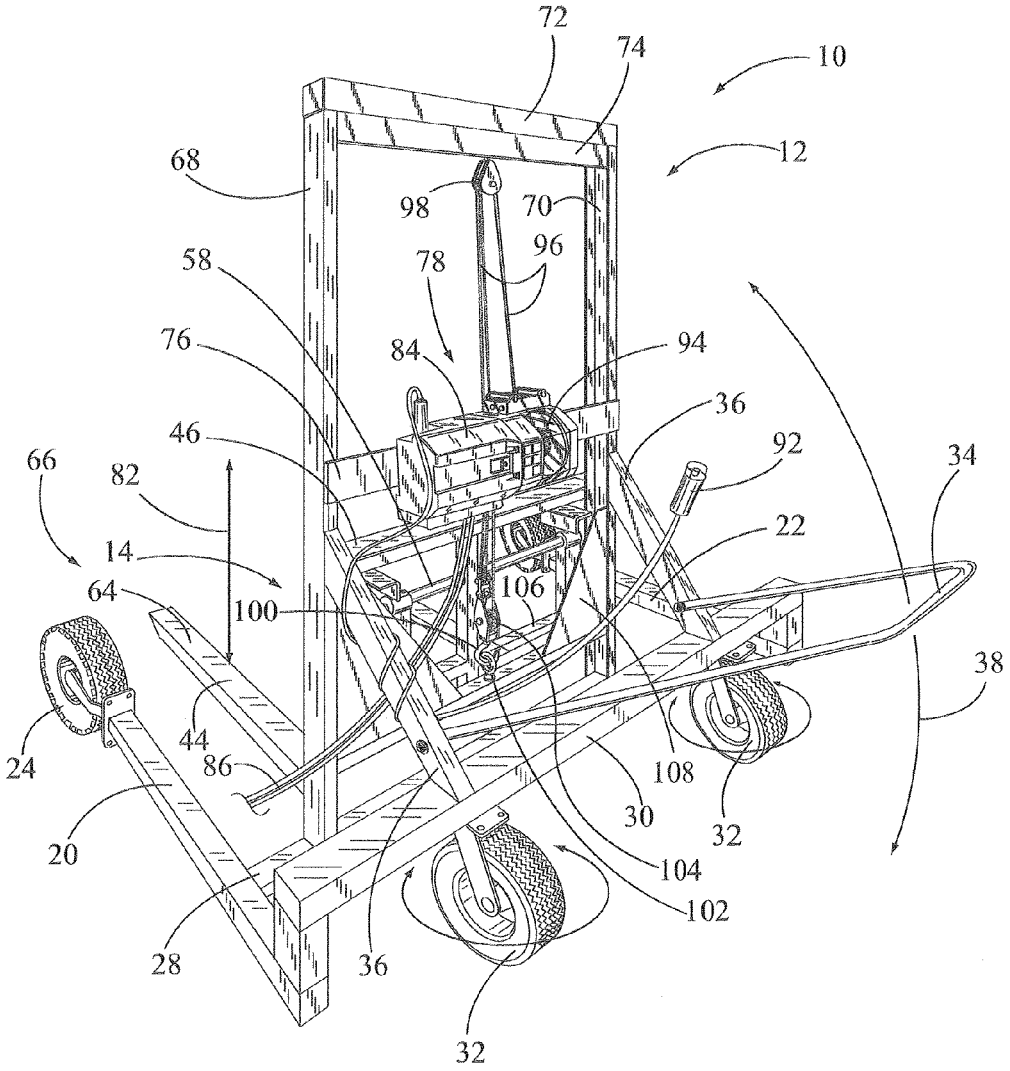
FIG. 2 is rear perspective view of the forklift and showing a battery operated winch assembly mounted on a vertical mast frame for raising and lowering the external vertical fork frame and attached lift forks.

The rear pivot wheels 32 are shown in FIG. 2. The front wheels 24 and the rear pivot wheels 32 can include changeable, inflatable pneumatic tires, sold rubber tires, plastic tires and the like.

A "U" shaped handle 34 is attached to a pair of angle support arms 36 attached at one end to a top of the rear wheel crossbar 30. The handle 34 pivots on the two angle support arms 36, as shown by arrow 38. An operator 40, illustrated in dashed lines, is shown holding the handle 34 for turning the rear wheels 32 and moving the forklift 10 back and forth.

The fork assembly 14 is mounted on front of the mast assembly 12 and includes a external vertical fork frame 42 and two outwardly extending, adjustable, "L" shaped lift forks 44 used for engaging and lifting pallets and other large items. The pallets are not shown in the drawings. The external vertical fork frame 42 includes a horizontal upper frame crossbar 46, an intermediate frame crossbar 48 and a lower frame crossbar 50. Opposite ends of the three crossbars 46, 48 and 50 are attached to a first vertical frame member 52, an intermediate vertical frame member 54 and a second vertical frame member 56. A horizontal pivot rod 58 is attached to the three vertical frame members 52, 54 and 56 and is disposed between the horizontal upper frame crossbar 46 and the intermediate frame crossbar 48. An upper end of a vertical portion 60 of the "L" shaped forks 44 includes a collar 62 received around a portion of the pivot rod 58. This feature allows the width between the forks 44 to be adjusted for different sizes of pallets and different widths of heavy goods to be handled. In this drawing, a horizontal portion 64 of the forks 44 is shown resting next to a floor, shown having a general reference numeral 66. The horizontal portion 64 includes a heel 67, which extends rearwardly under a portion of the lower frame crossbar 50. When a load is received on the forks 44, the heel 67 is compressed against the bottom of the crossbar 50, thus holding the forks 44 in place and adding overall strength to the external vertical fork frame 42.

Referring back to the mast frame 12 mentioned above, the vertical mast frame 16 includes a vertical "C" shaped, first mast frame member 68 and a parallel, vertical "C" shaped, second mast frame member 70. The lower ends of the mast frame members 68 and 70 are mounted on top of the lower mast crossbar 28. The vertical, "C" shaped, mast frame members 68 and 70 are joined together by a horizontal upper mast frame member 72 with a horizontal, upper support plate 74 and a horizontal, winch assembly support plate 76.

In FIG. 2, rear perspective view of the forklift 10 is shown. In this drawing, a winch lift assembly, having a general reference numeral 78, is mounted on the horizontal, winch assembly support plate 76. The winch assembly 78 is used for raising and lowering the fork assembly 14, as shown by arrows 80 in FIG. 1, and the forks 44, as shown by arrows 82. As mentioned above, the winch assembly 78 can be hand operated, as shown in FIG. 4, or it can be battery operated, as shown in this drawing and in FIGS. 1 and 3.

The battery operated winch assembly 78 includes an electric motor inside a motor housing 84 with electric battery leads 86 connected to a battery inside a battery housing 88. The battery housing 88 is shown in FIG. 1. The motor is also connected to an electric control lead 90 with hand operated, winch control 92 for turning the motor "on" and "off" and raising and lowering the forks 44. The motor inside the motor housing 84 is connected to a winch cable reel 94 for winding and unwinding a winch cable 96 thereon. The winch cable 96 extends upwardly and received over an upper mast pulley 98 with hook 100 received through a forged eye bolt 102 attached to the upper mast frame member 72. The hook 100 and the forged eye bolt 102 are shown in FIG. 1.

From the upper mast pulley 98, the winch cable 96 extends downwardly and is attached to a lower mast pulley 104 with hook 100 connected to a forged eye bolt 102. The forged eye bolt 102 is attached to a crossbar 106. The crossbar 106 is part of a sliding carriage assembly shown in detail in FIG. 9. The 106 is attached to the horizontal intermediate frame crossbar 48 of the fork assembly 14. The sliding carriage assembly is used for raising and lowering the fork frame 42 and attached forks 44. The crossbar 106 is shown attached to gussets 108 for adding strength to the carriage assembly.

Figure 3:
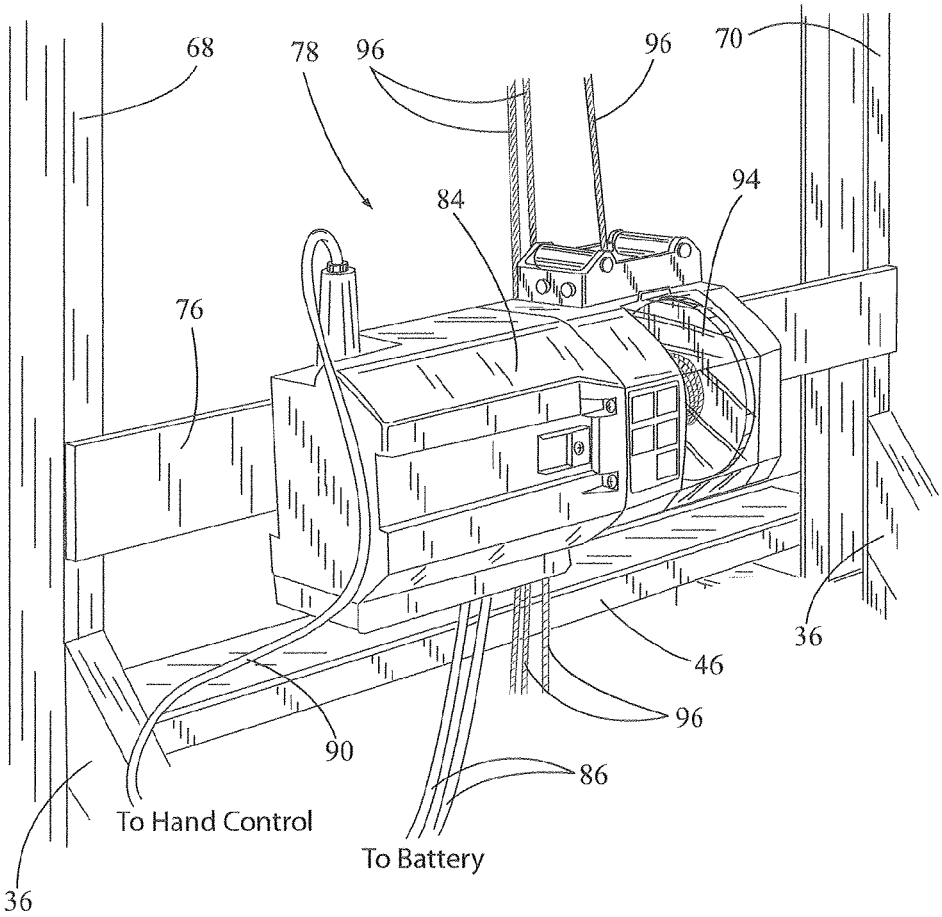
FIG. 3 is an enlarged perspective view of the battery operated winch assembly mounted on a winch assembly support plate attached to the vertical mast frame.
Figure 4:
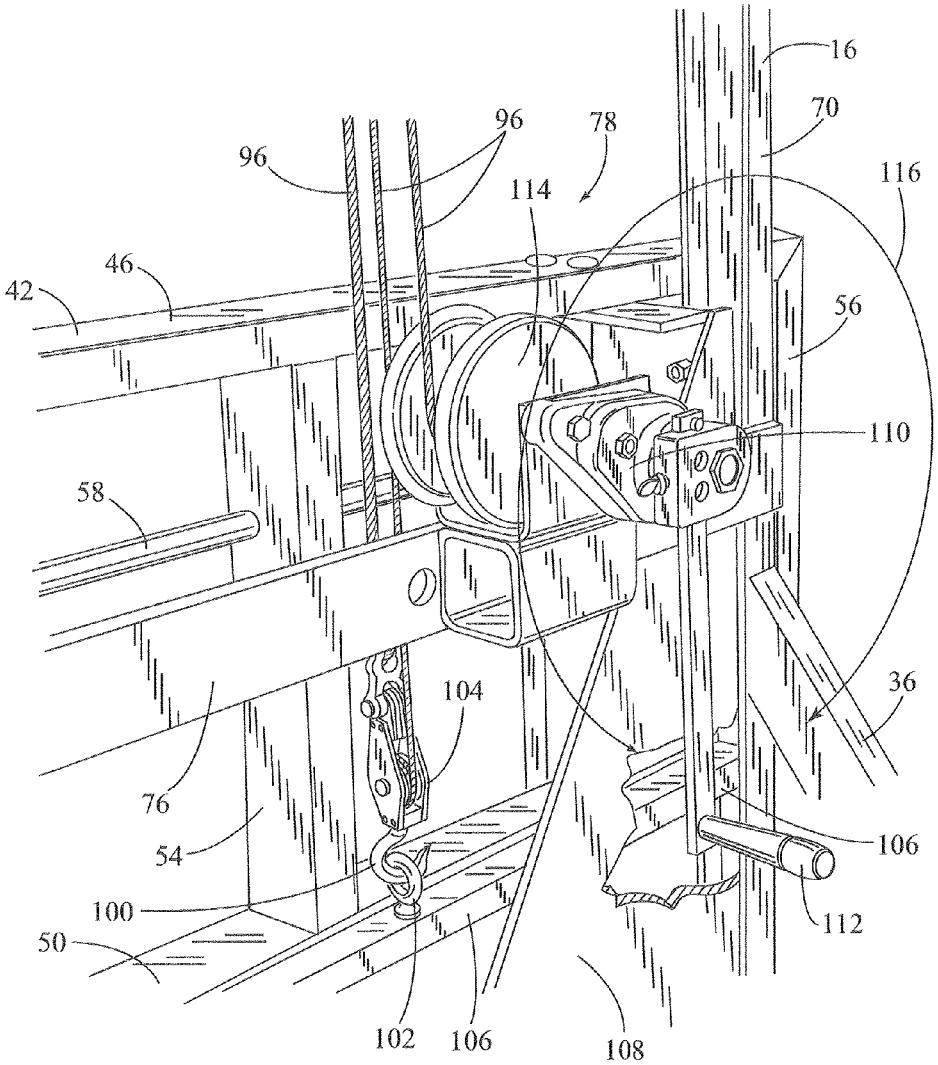
FIG. 4 is an enlarged perspective view of a hand operated winch assembly with hand crank and mounted on the winch assembly support plate of the vertical mast frame.

In FIG. 3, an enlarged perspective view of the battery operated winch lift assembly 78 is shown mounted on the horizontal, winch assembly support plate 76 and attached to the vertical mast frame 16. In this drawing, the winch lift assembly 78 using the winch cable 96 has lowered the lift assembly 14 and the pair of forks 44 down to the floor 66 as shown in FIGS. 1 and 2.

In FIG. 4, an enlarged perspective view of a hand operated winch lift assembly 78 is shown with a hand crank 110, with crank handle 112 mounted on the winch assembly support plate 76 attached to the vertical mast frame 16. The hand crank 110 is attached to a winch cable reel 114 for winding and unwinding the cable 96 thereon. In this drawing, the crank handle 112 and hand crank 110 have been turned, as indicated by arrow 116, to raise the fork assembly 14 and forks 44 on the vertical mast frame 16. A portion of one of the gussets 108 has been cut away to illustrate one end of the horizontal crossbar 106 received inside a portion of the vertical, "C" shaped second mast frame member 70.

Figure 5:
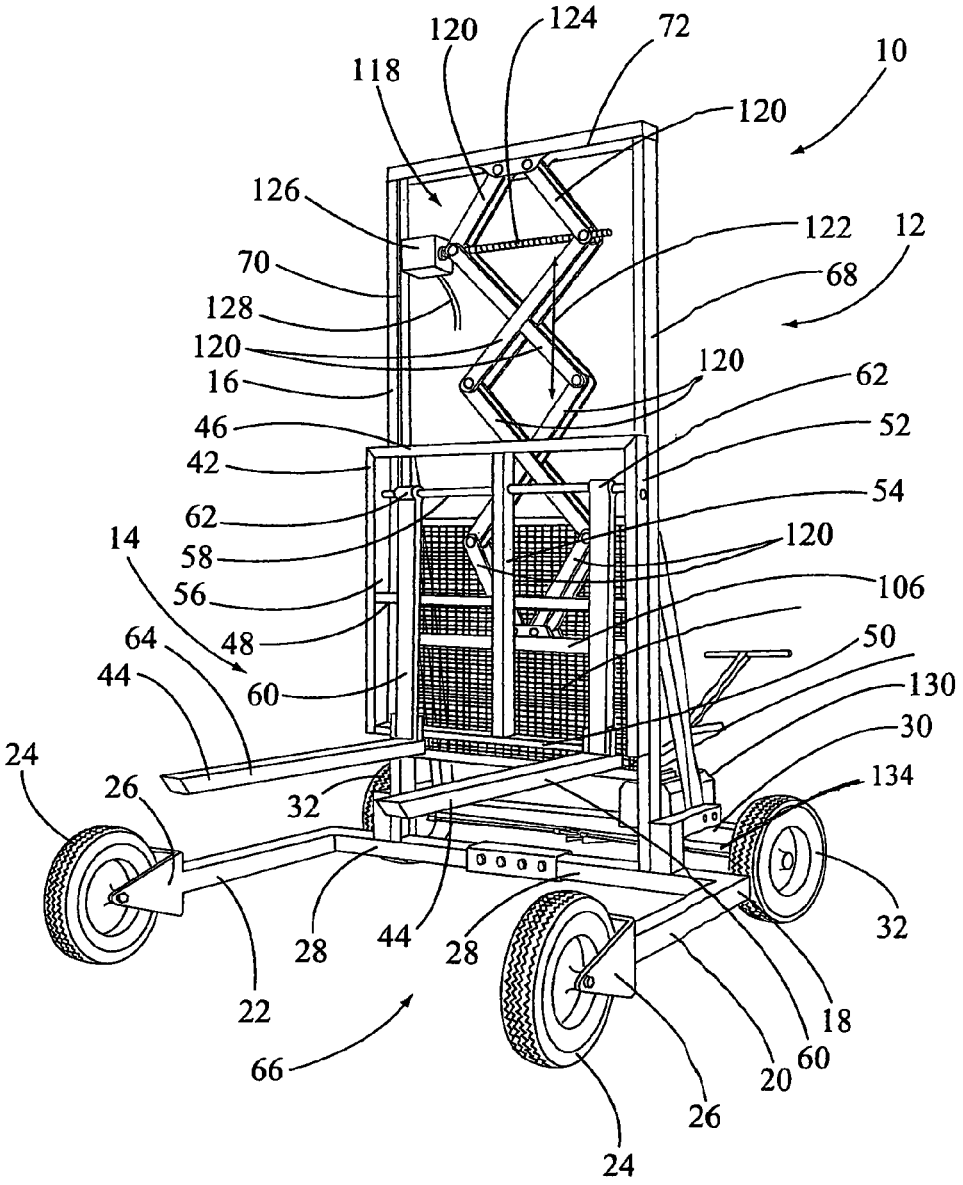
FIG. 5 is a front perspective view of another embodiment of the hand operated fork lift and illustrating a scissor arm lift assembly mounted on the vertical mast frame and used for raising and lowering the external vertical fork frame and attached lift forks.

In FIG. 5, another embodiment of the subject hand operated fork lift 10 is illustrated with a scissor arm lift assembly having a general reference numeral 118. The scissor arm lift assembly 118 includes a plurality of scissor arms 120 pivotally attached together for raising and lowering the fork assembly 14, as indicated by arrows 122. In this drawing, two of the upper scissor arms 120 are pinned to the upper mast frame member 72. Also, two of the lower scissor arms 120 are pinned to the crossbar 106. The crossbar 106 is attached to a portion of the external vertical fork frame 42. A safety screen 125 is mounted on the rear of the vertical mast frame 16 for protecting the operator 40 during the operation of the forklift 10

The scissor arm lift assembly 118 includes a horizontal screw rod 124 threadably attached to two of the upper scissor arms 120. One end of the screw rod 124 is attached to a drive motor 126 mounted on the second mast frame member 70. The motor 126 includes battery leads 128, which are connected to a battery inside a battery housing 130. The battery housing 130 is mounted on the rear wheel crossbar 30. A solar cell panel 132 is shown disposed on top of the battery housing 130 and used for recharging the battery during daylight hours.

In this drawing, a portion of a tie rod assembly 134 is shown and disposed under the rear wheel crossbar 30. The ends of the tie rod assembly are connected to the two rear wheels 32. A "T" shape handle 136 is connected to the tie rod assembly 134 for turning the rear wheels 32, as indicated by arrow 138 shown in FIG. 6.

Figure 6:
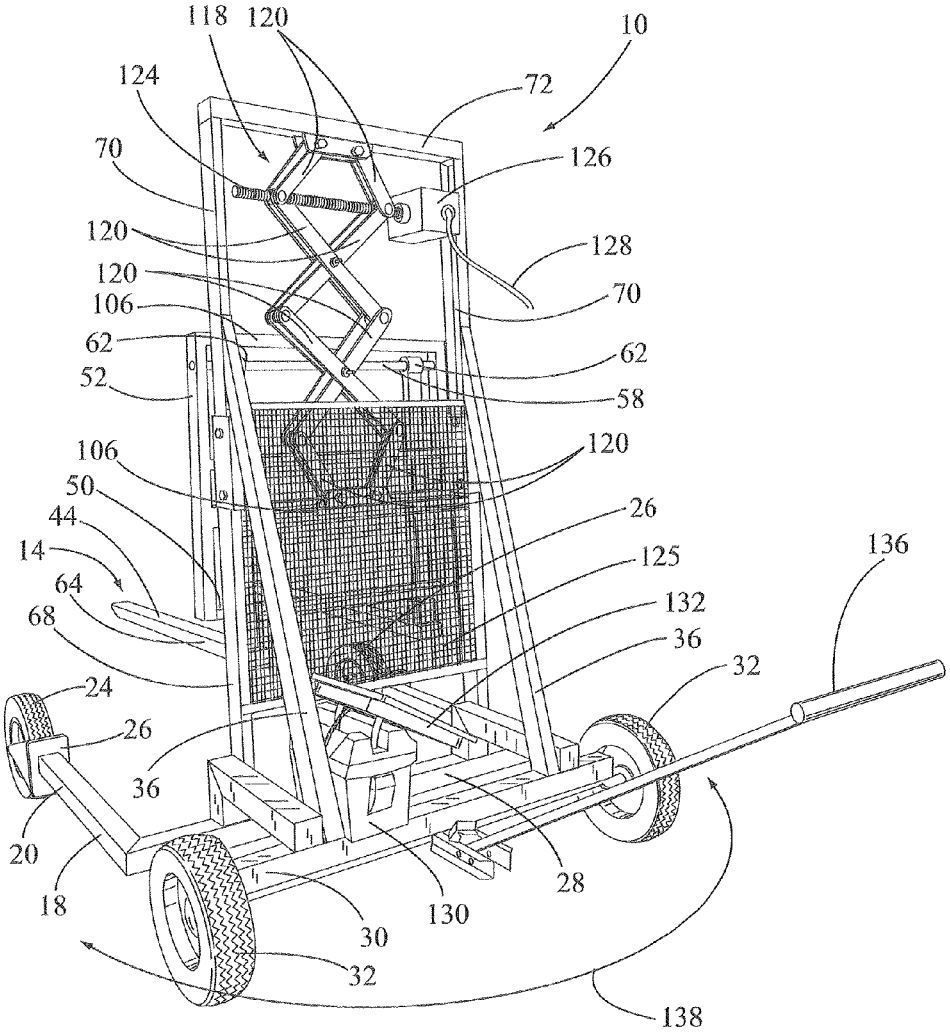
FIG. 6 is a rear perspective of the hand operated fork lift shown in FIG. 5 and illustrating the battery housing used for activating a motor drive and operating the scissor lift assembly.

In FIG. 6, a rear perspective view of the hand operated fork lift 10 is illustrated as shown in FIG. 5. In the operation of the scissor arm assembly, it is important to note that the scissor arms 120 are held in tension when a load is placed on the lift forks 44. By actuating the drive motor 126 in one direction, the screw rod 124 is used to close the scissor arms 120 toward each other placing the arms in compression and in turn raise the fork assembly 14 with lift forks 44. Likewise, by reversing the direction of the screw rod 124, the scissor arms 120 are opened and away from each other and placing the arms in tension for lowering the fork assembly 14.

Figure 7:
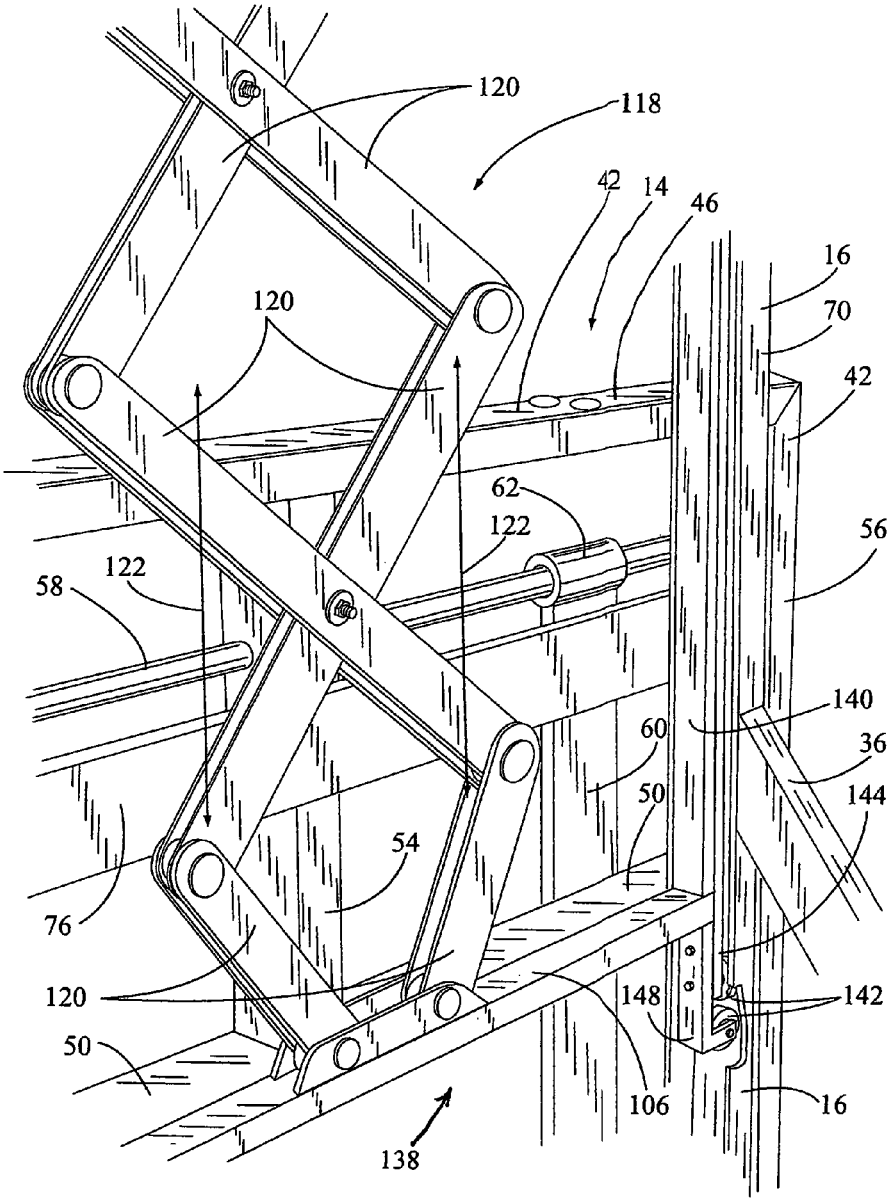
FIG. 7 is an enlarged rear view of a portion of the scissor arm lift assembly used for raising and lowering the fork assembly.

In FIG. 7, an enlarged sectional view of a rear of a lower portion of the scissor arm lift assembly 118 is illustrated. In this view, two of the lower scissor arms 120 are shown attached to the top of the crossbar 106 is shown. The crossbar 106 is connected to the horizontal lower frame crossbar 50 for raising and lower the fork assembly 14.

Figure 9:
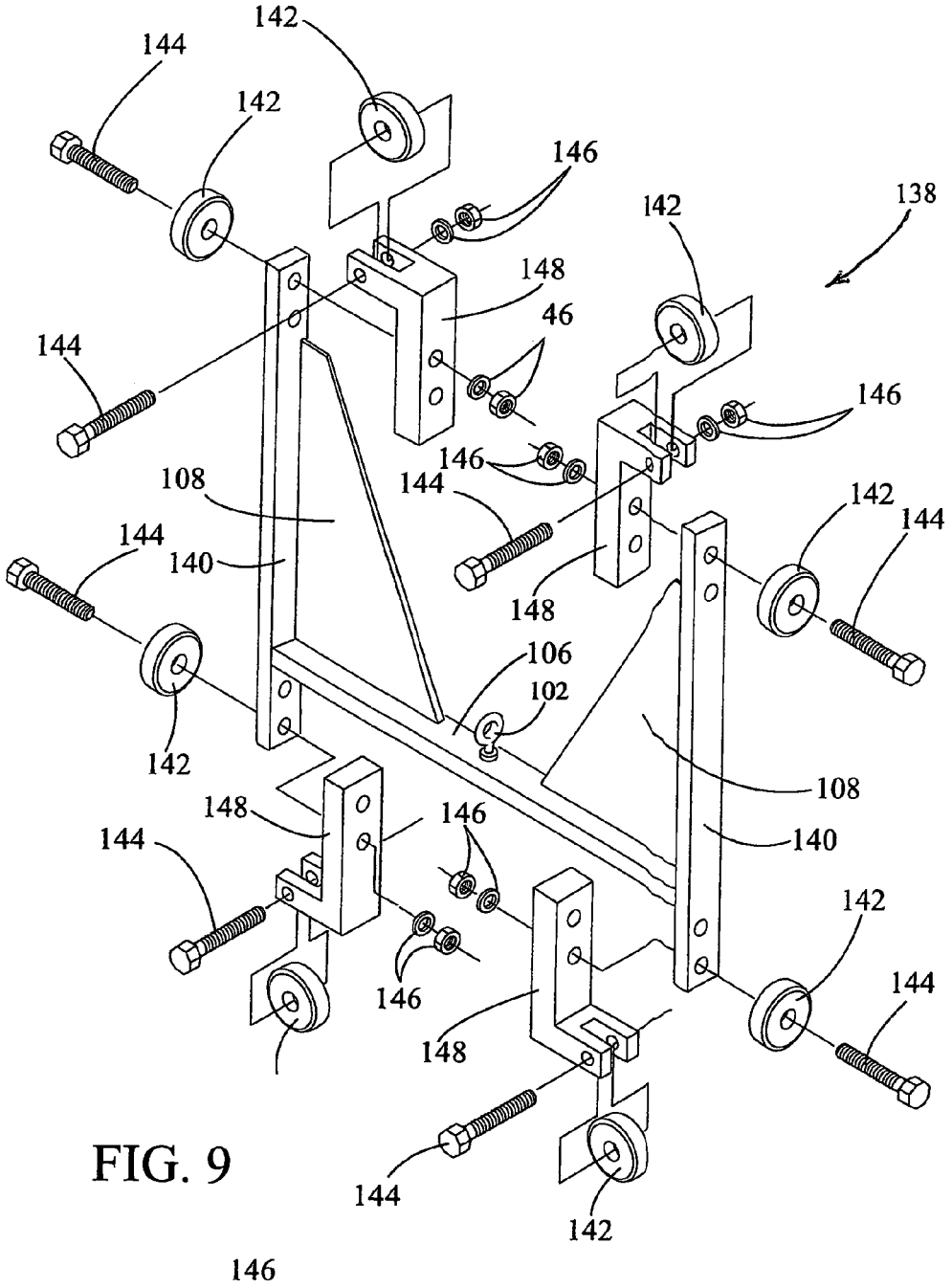
FIG. 9 is an exploded perspective view of a sliding carriage assembly with wheel bearings mounted thereon for sliding up and down vertical mast frame members when the fork frame and lift forks are raised and lowered on the subject fork lift.

In this drawing, a portion of a sliding carriage assembly 138 is shown. A complete view of the carriage assembly 138 is illustrated in FIG. 9. One end of the crossbar 106 is shown attached to a lower end of a vertical assembly frame member 140. Also attached to the lower end of the frame member 140 is a "L" shaped bracket 148 having a wheel bearing 142 mounted thereon. The wheel bearing 142 rides up and down inside the "C" shaped mast frame member 70.

Figure 8:
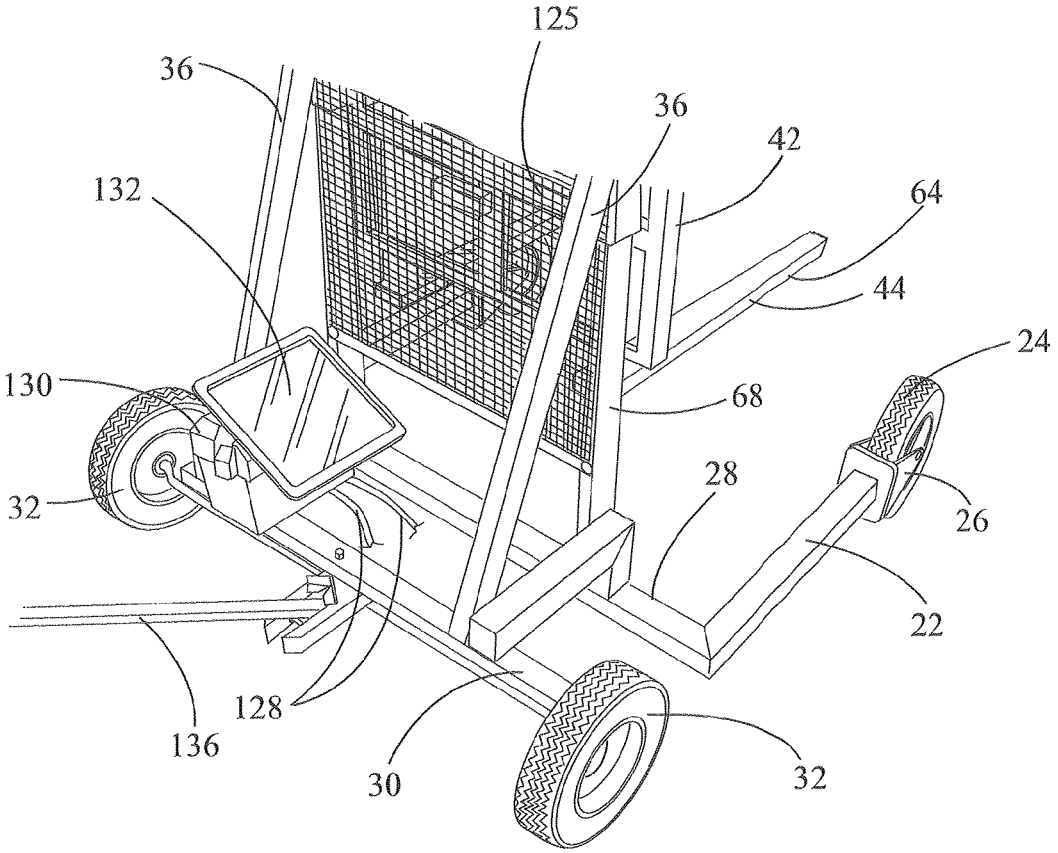
FIG. 8 is a rear perspective view of a lower portion of the forklift and illustrating a solar panel mounted on top of a battery housing for charging the lift's battery during sunlight hours.

In FIG. 8, a rear perspective view of a rear of a lower portion of the hand operated fork lift 10 is shown. In this view the solar cell panel 132 is shown mounted above the battery housing 130 and connected to batter leads 128. A part of the tie rod assembly 134 is shown connected to the "T" shaped handle 136 for rotating and steering the rear wheels 32 when moving the hand operated fork lift 10.

In FIG. 9, an exploded perspective view of the sliding carriage assembly 138 is shown, which is used with the winch cable 96 and the scissor arms 106. The carriage assembly 138 includes a pair of parallel, vertical assembly frame members 140 with wheel bearings 142 mounted on the ends thereof using bolts 144 and nuts and washers 146. Also, the "L" shaped brackets 148 are attached to opposite ends of the frame members 140 and include wheel bearings 142 mounted thereon. Obviously, the sliding carriage assembly 138 with wheel bearings 142 riding inside the "C" shaped mast frame members 68 and 70 prevent the lift frame 42 from binding as the lift forks 44 are raised and lowered on the fork lift 10.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A lightweight, portable, hand operated forklift for lifting pallets of product and other heavy items both indoors and outdoors, the forklift comprising:

a mast assembly having a vertical mast frame;

a horizontal mast frame, the vertical mast frame mounted on top of the horizontal mast frame, the horizontal mast frame having a first outrigger arm with a first front wheel mounted on an end thereof and having a parallel second outrigger arm with a second front wheel mounted on an end thereof, the first and second front wheels including changeable, inflatable pneumatic tires;

a pair of rear wheels, the rear wheels including changeable, inflatable pneumatic tires, the rear wheels pivotally mounted on opposite ends of a tie rod assembly, the tie rod assembly mounted on a rear of the horizontal mast frame;

a handle attached to the tie rod assembly, the handle used for turning the tie rod assembly and the rear wheels and moving the forklift when loading and unloading;

a fork assembly mounted in front of the vertical mast frame, the fork assembly including a vertical fork frame and two outwardly extending, adjustable, "L" shaped forks pivotally mounted thereon, a width between the "L" shaped forks is adjustable for different size pallets, the vertical fork frame with the "L" shaped forks received between the first outrigger arm and second outrigger arm, the first and second outrigger arms providing forklift stability during the operation of the fork lift;

a scissor arm lift assembly mounted on the vertical mast frame and attached to the vertical fork frame, the scissor arm lift assembly used for raising the vertical fork frame and the "L" shaped forks between the first and second outrigger arms and lowering the "L" shaped forks to a floor or ground surface, the scissor arm lift assembly having a plurality of scissor arms pivotally attached to each other, two of the scissor arms attached to an upper mast frame member, the upper mast frame member horizontally mounted at a top end of the vertical mast frame, and two of the scissor arms attached to a sliding carriage assembly, the sliding carriage assembly attached to the vertical fork frame, the scissor arm lift assembly attached to and driven by a drive motor, the scissor arm lift assembly placed in tension when a load is placed on the "L" shaped forks; and a safety screen vertically mounted on a rear-facing side of the vertical mast frame, the safety screen protecting a forklift operator during the operation of the forklift.

2. The forklift as described in claim 1 wherein the scissor arm lift assembly includes a horizontal screw rod rotatably attached to two of the scissor arms, one end of the screw rod attached to the drive motor.

3. The forklift as described in claim 1 wherein the sliding carriage assembly includes wheel bearings received inside a pair of vertical "C" shaped mast frame members, the vertical "C" shaped mast frame members part of the vertical mast frame.

4. The forklift as described in claim 1 wherein the drive motor is connected to a battery leads attached to a battery inside a battery housing, the battery housing mounted on the horizontal mast base frame.

5. A lightweight, portable, hand operated forklift for lifting pallets of product and other heavy items both indoors and outdoors, the forklift comprising:

a mast assembly having a vertical mast frame;

a horizontal mast frame, the vertical mast frame mounted on top of the horizontal mast frame, the horizontal mast frame having a first outrigger arm with a first front wheel mounted on an end thereof and having a parallel second outrigger arm with the second front wheel mounted on an end thereof, the first and second front wheels including changeable, inflatable pneumatic tires;

a pair of rear wheels, the rear wheels including changeable, inflatable pneumatic tires, the rear wheels pivotally mounted on opposite ends of a tie rod assembly, the tie rod assembly mounted on a rear of the horizontal mast frame;

a handle attached to the tie rod assembly, the handle used for turning the tie rod assembly and the rear wheels and moving the forklift when loading and unloading;

a fork assembly mounted in front of the vertical mast frame, the fork assembly including a vertical fork frame and two outwardly extending, adjustable, "L" shaped forks pivotally mounted thereon, a width between the "L" shaped forks is adjustable for different size pallets, the vertical fork frame with the "L" shaped forks received between the first outrigger arm and second outrigger arm, the first and second outrigger arms providing forklift stability during the operation of the fork lift;

a scissor arm lift assembly mounted on the vertical mast frame and attached to the vertical fork frame, the scissor arm lift assembly for raising the vertical fork frame and the "L" shaped forks between the first and second outrigger arms and lowering the "L" shaped forks to a floor or ground surface, the scissor arm lift assembly having a plurality of scissor arms pivotally attached to each other, two of the scissor arms attached to an upper mast frame member, the upper mast frame member horizontally mounted at a top end of the vertical mast frame, and two of the scissor arms attached to a sliding carriage assembly, the sliding carriage assembly attached to the vertical fork frame, the scissor arm lift assembly attached to and driven by a drive motor, the scissor arm lift assembly including a horizontal screw rod rotatably attached to two of the scissor arms, one end of the screw rod attached to the drive motor, the scissor arm lift assembly placed in tension when a load is placed on the "L" shaped forks; and a safety screen vertically mounted on a rear-facing side of the vertical mast frame, the safety screen protecting a forklift operator during the operation of the forklift.

6. The forklift as described in claim 5 wherein the sliding carriage assembly includes wheel bearings received inside a pair of vertical "C" shaped mast frame members, the vertical "C" shaped mast frame members part of the vertical mast frame.

7. The forklift as described in claim 5 wherein the drive motor is connected to a battery leads attached to a battery inside a battery housing, the battery housing mounted on the horizontal mast base frame.

* * * * *